United States Patent [19]

Rickard

[11] 4,188,849

[45] Feb. 19, 1980

[54] PICKUP FOR STRINGED MUSICAL INSTRUMENT

[75] Inventor: James H. Rickard, Harwinton, Conn.

[73] Assignee: Ovation Instruments, Inc., New Hartford, Conn.

[21] Appl. No.: 5,519

[22] Filed: Jan. 22, 1979

Related U.S. Application Data

[63] Continuation of Ser. No. 760,734, Jan. 19, 1977, abandoned.

[51] Int. Cl.[2] ..... G10H 3/00; G10H 3/08

[52] U.S. Cl. ..... 84/1.15; 84/1.16

[58] Field of Search ..... 84/1.15, 1.16

[56] References Cited

U.S. PATENT DOCUMENTS

| | | | |
|---|---|---|---|
| 1,896,683 | 2/1933 | Clark | 84/1.16 |
| 2,612,072 | 9/1952 | De Armond | 84/1.15 |
| 2,896,491 | 7/1959 | Lover | 84/1.15 |
| 3,194,870 | 7/1965 | Tondreau et al. | 84/1.16 |
| 3,244,791 | 4/1966 | Hull et al. | 84/1.15 |
| 3,443,018 | 5/1969 | Krebs | 84/1.16 |
| 3,472,943 | 10/1969 | Kawabata et al. | 84/1.15 |

FOREIGN PATENT DOCUMENTS

| | | | |
|---|---|---|---|
| 2140132 | 2/1972 | Fed. Rep. of Germany | 84/1.16 |

*Primary Examiner*—Stanley J. Witkowski

*Attorney, Agent, or Firm*—McCormick, Paulding & Huber

[57] ABSTRACT

An electromagnetic pickup for a stringed musical instrument has a plurality of magnet and coil signal generating units each associated with a respective one of the strings, and the housing which contains the signal generating units also contains an associated plurality of adjustable potentiometers whereby the contribution of each generating unit to a composite output signal may be varied. A fixed resistance connected to each potentiometer prevents each generating unit from being turned entirely off, and another fixed resistance in the main output line assures an acceptable input impedance to a tone control and amplifier, or other utilization circuit, to which the pickup is connected.

5 Claims, 4 Drawing Figures

Fig. 1
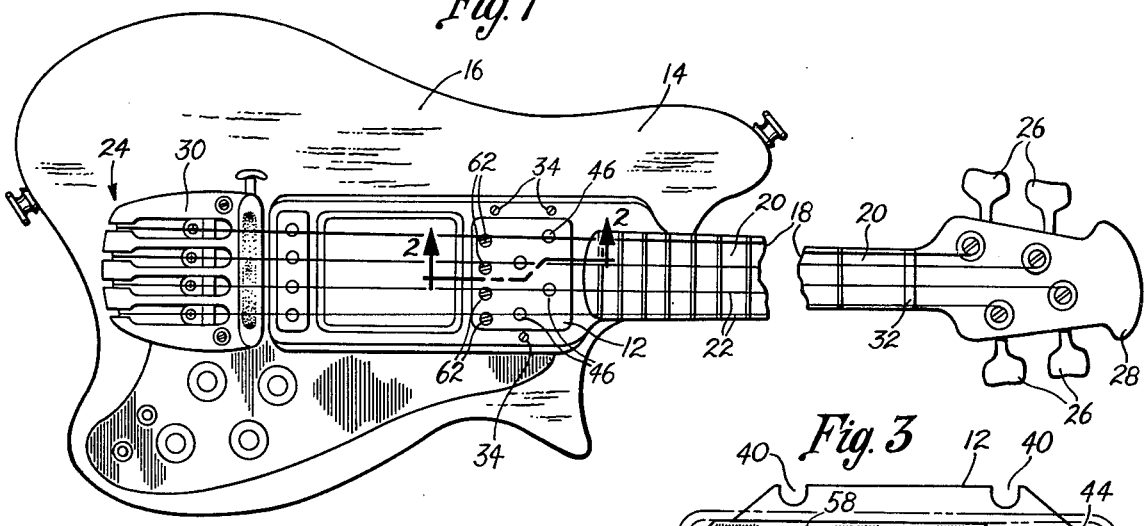
Fig. 3
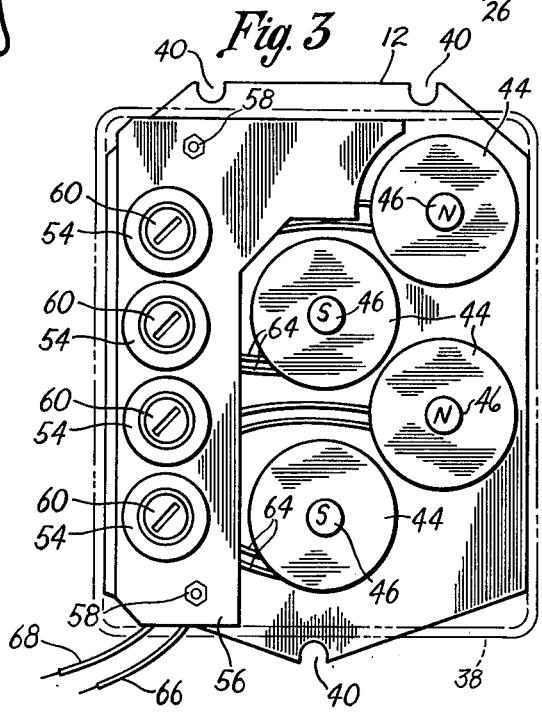
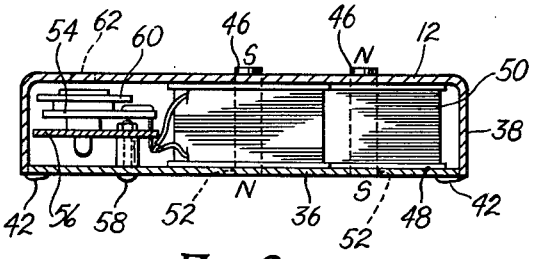
Fig. 2
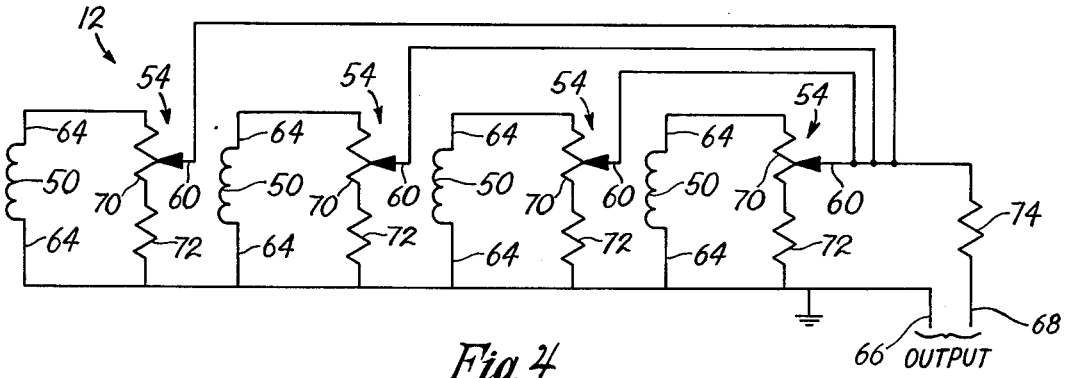
Fig. 4

PICKUP FOR STRINGED MUSICAL INSTRUMENT

This is a continuation of application Ser. No. 760,734 filed Jan. 19, 1977, and now abandoned.

BACKGROUND OF THE INVENTION

This invention relates to pickups for stringed musical instruments, and deals more particularly with such a pickup which produces a single composite output signal having components derived from the vibration of all of the strings and wherein the contribution made by each string to such composite output signal may be readily varied.

Electromagnetic pickups for guitars and other stringed musical instruments are well known. A common design of such a pickup is typified by the disclosure of U.S. Pat. No. 2,909,092 wherein each of a plurality of bar magnets is positioned near a respective one of the instrument's strings and are surrounded by a common signal generating coil so that the output signal from the coil is made up of components from all of the strings which happen to be vibrating at any given time. In many instances, it is desirable to vary or control the contribution of each string to such output signal and this has conventionally been accomplished, as for example in the aforementioned patent, by providing a means for adjustably moving each bar magnet toward or away from its associated string.

The general object of this invention is, therefore, to provide an electromagnetic pickup having an improved means for controlling the individual contribution of each string to the output signal, and a further object is to provide such a pickup having improved immunity to stray magnetic and electric fields.

Other objects and advantages of the invention will be apparent from the following detailed description of the preferred embodiment of the invention and from the drawings forming a part hereof.

SUMMARY OF THE INVENTION

This invention resides in an electromagnetic pickup for a stringed musical instrument having a plurality of signal generating units, one for each string of the instrument, each including a permanent bar magnet and a coil surrounding the magnet. The units are mounted on a supporting base so that each magnet underlies its associated string, and the coil of each unit is connected across the resistor of a respective one of a plurality of potentiometers. One end of each coil is connected to one of two output conductors, and the wipers of the potentiometers are all connected in common to the other of the two output conductors. A fixed resistor is connected in series with each potentiometer resistor to prevent the associated coil from being turned entirely off. A fixed series resistance is also provided in the second output conductor to maintain the input impedance to the associated utilization circuit at a desirable high level despite settings of the potentiometers which would otherwise produce an undesirably low input impedance.

BRIEF DESCRIPTION OF THE DRAWINGS

FIG. 1 is a plan view of a guitar equipped with a pickup embodying this invention.

FIG. 2 is an enlarged sectional view through the pickup of FIG. 1 and taken on the line 2—2 thereof.

FIG. 3 is a plan view of the pickup of FIG. 2 with this view showing the housing cover removed from the pickup.

FIG. 4 is a wiring diagram of the pickup of FIG. 1.

DETAILED DESCRIPTION OF THE PREFERRED EMBODIMENT

In FIG. 1, an electromagnetic pickup 12 embodying this invention is shown as part of an electric string bass 14. The bass 14 has a solid body 16, a neck 18 equipped with a fret board 20, and a set of four strings 22, 22. The strings are connected at their left-hand ends to a tailpiece means, indicated generally at 24, and at their other ends are connected to machine heads 26, 26 carried by a peg head 28, the strings further being stretched between a bridge means indicated generally at 30, adjacent the tailpiece means 24, and a nut 32, adjacent the peg head 28.

The pickup 12 in the illustrated case is usually referred to as a "neck" pickup insofar as it is located near the instrument's neck 18. It is received in a cavity of the body 16 and is preferably attached to the body in such a way that it may be both raised and lowered and tilted relative to the strings 22, 22 to bring it into proper heighth relationship therewith. Such mounting means may vary without departing from the invention, but preferably and as illustrated, it is a three point mounting system such as shown and described in U.S. Pat. No. 3,992,972. The three screws 34, 34 shown in my FIG. 1 are the three adjustment screws of the mounting system.

Referring to FIGS. 2 and 3, the pickup 12 includes a housing made up of a base 36 of brass or other electrically conductive non-magnetic material and a generally inverted cup-shaped cover 38 of similar electrically conductive non-magnetic material. At each of its opposite ends, the base 36 has a flange which extends beyond the cover 38, one flange providing one slot 40 and the other flange providing two slots 40, 40 for cooperation with the remainder of the supporting system. Along its lower edge, the cover 38 is fixed to the base 36 by soldering, as indicated at 42.

Carried by the base 36 are four individual signal generating units 44, 44. Each of these units includes a bar magnet 46 received in a plastic bobbin 48 and a coil 50 wound on the bobbin and surrounding the magnet. Each unit is located relative to the base 36 by having the lower end of its magnet 46 received in a conforming opening 52 in the base, and the units are further held in place by having the upper and lower flanges of their bobbins 48 engaged respectively by the base 36 and cover 38. As will be evident from FIG. 1, the generating units 44, 44 are further so arranged that the magnet 46 of each unit underlies a respective one of the strings 22, 22 so that the signal generated in the coil of that unit will be a signal resulting primarily from the vibration of its associated string.

Associated with each signal generating unit 44 is a potentiometer 54 adjustable to control the contribution of the unit to the single output signal from the pickup. These potentiometers 54, 54 may be located, in keeping with the broader aspects of the invention, at some point remote from the generating units 44, 44 but preferably, and as shown, are mounted on the housing base 36 along with the generating units. As shown in FIGS. 2 and 3, the four potentiometers 54, 54 are mounted on a circuit board 56 attached to the base 36 by two fastener and spacer assemblies 58, 58, and each potentiometer includes a rotatably adjustable wiper 60 having a slot adapted to receive a screw driver, the slot being accessible through an aligned opening 62 in the cover 38. The coil of each signal generating unit 44 has two leads 64, 64 which connects it to its associated potentiometer 54 in the manner shown in FIG. 4. The pickup 12 further has two output conductors 66 and 68 which deliver the output signal from the pickup to a tone control and amplifier, or other utilization circuit.

With further reference to FIGS. 2 and 3, the magnets 46, 46 of the signal generating units 44, 44 have opposite magnetic polarities at their upper and lower end faces and the magnets are so arranged that in proceeding across the pickup from the upper end face of one magnet to the upper end face of the next, alternating magnetic polarities are encountered. The two coils 50, 50 associated with the two magnets having upper end faces of south magnetic polarity are so wound and connected to their potentiometers, in comparison to the winding directions and connections of the other two coils 50, 50, that signals induced in the first two coils by a stray varying magnetic field having a component parallel to the axis of the magnets will buck and therefore at least partially cancel similar signals induced in the other two coils, thereby reducing the amount of noise included in the output signal because of such stray field. Also, the pickup housing, comprised of the base 36 and cover 38, substantially entirely surrounds the pickup with electrically conductive material and therefore shields the coils 50, 50 from stray electric fields to thereby minimize the noise appearing in the output signal because of such fields.

Referring to FIG. 4, the output line 66 is a ground line which is electrically connected to the pickup housing. Each generating unit coil 50 has one end connected to the upper end of its potentiometer resistor 70 and its other end connected to ground. The lower end of each potentiometer resistor 70 is in turn connected to the ground through a fixed resistor 72. The wiper 60 of each potentiometer is connected to a point common to all of the wipers and this common point is in turn connected to the output conductor 68 through a fixed resistor 74. The fixed resistor 72 associated with each potentiometer prevents the signal from the associated coil 50 from being entirely turned off relative to the output conductor 68. That is, the resistor 72 ensures that at least a minimum portion of the associated coil signal will be delivered to the conductor 68.

The output conductors 66 and 68 are customarily connected to a tone control and amplifier or similar utilization circuit which requires a given input impedance to function properly. In the absence of the resistor 74, if all of the wipers 60, 60 were set to pickup relatively low resistance values, the resulting impedance of the pickup might be too low to satisfactorily match the requirement of the utilization circuit. The resistor 74 imposes a sufficient amount of resistance to avoid this problem.

I claim:

1. An electromagnetic pickup for a stringed musical instrument having a set of generally parallel strings, said pickup comprising: a housing, said housing including a base adapted for attachment to said instrument and a generally cup-shaped cover attached to said base, a plurality of signal generating units mounted on said base within said housing each including a permanent bar magnet and a coil surrounding said magnet, said magnets each having an upper and a lower end face of opposite magnetic polarities, said magnets being arranged with their axes parallel to one another with said upper end faces of said magnets each underlying a respective one of said strings when said pickup is installed on said instrument, each of said coils having two leads across which a voltage signal induced therein appears, a plurality of potentiometers in said housing each including a resistor and an associated adjustable wiper, means connecting said two leads of each of said coils across said resistor of a respective one of said potentiometers, two output conductors extending from said housing, means in said housing connecting one of said leads of each of said coils to the same one of said two output conductors, and means within said housing connecting each of said wipers of said potentiometers to the other of said two output conductors.

2. An electromagnetic pickup as defined in claim 1 further characterized by said means connecting each of said wipers to said other output conductor including means connecting all of the wipers of said potentiometers to a common point, and a fixed resistance connected between said common point and said other of said output conductors.

3. An electromagnetic pickup as defined in claim 1 further characterized by said cover having openings therein aligned with said potentiometers and each of said potentiometers having an adjustable member aligned with and accessible through its associated one of said cover openings, each of said cover openings being so located on said cover as to be positioned adjacent the string with which its associated signal generating unit is associated.

4. An electromagnetic pickup for a stringed musical instrument having a set of generally parallel strings, said pickup comprising: a base adapted for attachment to said instrument, a plurality of signal generating units mounted on said base each including a permanent bar magnet and a coil surrounding said magnet, said magnets each having an upper and a lower end face of opposite magnetic polarities, said magnets being arranged with their axes parallel to one another with said upper end faces of said magnets each underlying a respective one of said strings when said pickup is installed on said instrument, each of said coils having two leads across which a voltage signal induced therein appears, a plurality of potentiometers each including a resistor and an associated adjustable wiper, means connecting said two leads of each of said coils across said resistor of a respective one of said potentiometers, two output conductors, means connecting one of said leads of each of said coils to one of said output conductors, and means connecting each of said wipers of said potentiometers to the other of said output conductors, each of said resistors of said potentiometers having one end connecting directly to one end of its asosciated coil, and a fixed resistor connected between the other end of said potentiometer resistor and said one of said output conductor.

5. An electromagnetic pickup as defined in claim 4 further characterized by said means connecting each of said wipers to said other output conductor including means connecting all of the wipers of said potentiometers to a common point, and a fixed resistance connected between said common point and said other of said output conductors.

* * * * *